United States Patent [19]

Howie, Jr.

[11] 3,946,186

[45] Mar. 23, 1976

[54] ROCKER ACTUATING MECHANISM

[75] Inventor: Robert K. Howie, Jr., Decatur, Ill.

[73] Assignee: The Grigoleit Company, Decatur, Ill.

[22] Filed: Dec. 26, 1973

[21] Appl. No.: 427,468

[52] U.S. Cl. ..... 200/339; 200/293; 200/330

[51] Int. Cl.[2] ..... H01H 9/02; H01H 3/02

[58] Field of Search ..... 200/330, 332, 331, 335, 200/339, 293, 297

[56] References Cited

UNITED STATES PATENTS

| | | | |
|---|---|---|---|
| 1,924,351 | 8/1933 | Doddridge | 200/330 |
| 2,045,636 | 6/1936 | Darling | 200/339 |
| 2,155,244 | 4/1939 | Sambleson | 200/339 X |
| 2,670,421 | 2/1954 | Coutant | 200/283 X |
| 3,146,330 | 8/1964 | Miller | 200/339 |
| 3,217,112 | 11/1965 | Campbell et al. | 200/339 X |
| 3,770,915 | 11/1973 | Bennett et al. | 200/6 A |

*Primary Examiner*—Robert K. Schaefer
*Assistant Examiner*—William J. Smith
*Attorney, Agent, or Firm*—Kinzer, Plyer, Dorn & McEachran

[57] ABSTRACT

An actuating mechanism which can be adapted for use in devices such as a rocker type electrical switch assembly. The rocker can be inserted in a housing through an opening in one side thereof. The rocker is held for rotation about a fixed axis by the combination of the closure member for the housing opening and parts of the housing which engage the rocker.

9 Claims, 8 Drawing Figures

ROCKER ACTUATING MECHANISM

Summary of the Invention

This invention is directed to a rocker type actuating mechanism and more particularly to an actuating mechanism which may be adapted for use in an electrical switch.

An object of this invention is a rocker type actuating mechanism in which the rocker is slid into its housing through an opening therein and is held in position by a closure member for the opening.

Another object is a rocker type actuating mechanism in which it is not necessary to fix the rocker to the housing before completion of the assembly.

Another object of a rocker type actuating mechanism in which the rocker is inserted in a housing from an opening in one side thereof and is held by the housing against movement in all directions except towards its opening with movement in this direction limited by a closure member.

Another object is a rocker type actuating mechanism in which the rocker is held in the housing for rotation about a fixed axis by engagement of the peripheral wall of the rocker with the walls of the housing and with the closure member.

Another object is a rocker type actuating mechanism having a rocker which is held in a housing for rotation about a fixed axis by means of engagement of the trunnions of the rocker with the walls of slots formed in the housing and by engagement of the peripheral wall of the rocker with a closure member for an opening in the housing.

Another object is a rocker type actuating mechanism in which the rocker is held for rotation about a fixed axis by means of trunnions which engage portions of the housing and by engagement of the peripheral wall of the rocker with the housing and with a closure member for the housing.

Another object is a rocker type electrical switch assembly in which the switch holds the rocker in the housing.

Other objects may be found in the following specification, claims and drawings.

Brief Description of the Drawings

The invention is illustrated more or less diagrammatically in the following drawings wherein.

Description of the Preferred Embodiments

The rocker type actuating mechanism of this invention is shown embodied in electrical switch assemblies, but it should be understood that this showing is by way of illustration and the invention is susceptible of other applications.

Figure 1:
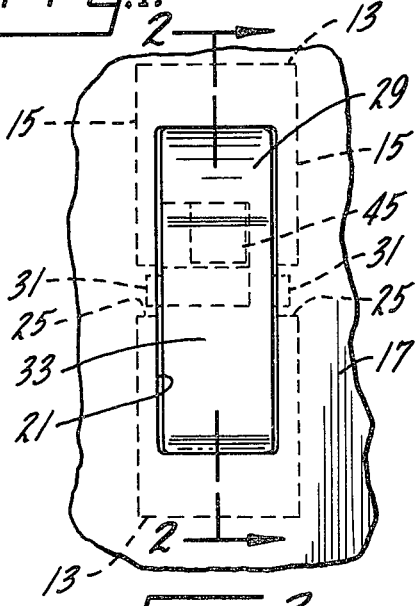
FIG. 1 is a front elevational view of a rocker type actuator of this invention embodied in an electrical switch.
Figure 2:
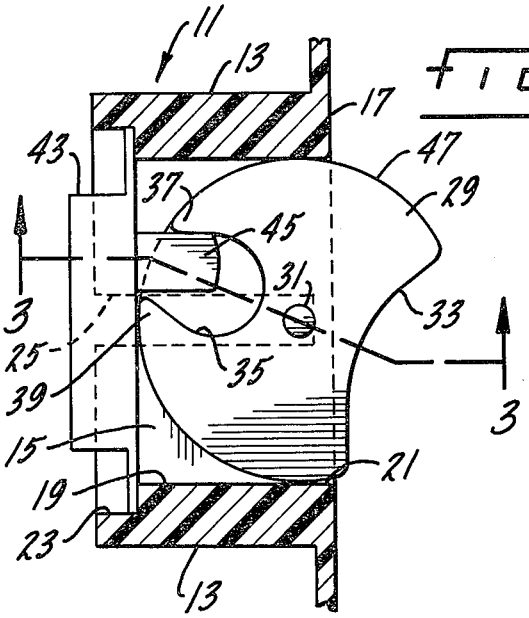
FIG. 2 is a cross-sectional view taken along line 2—2 of FIG. 1.
Figure 3:
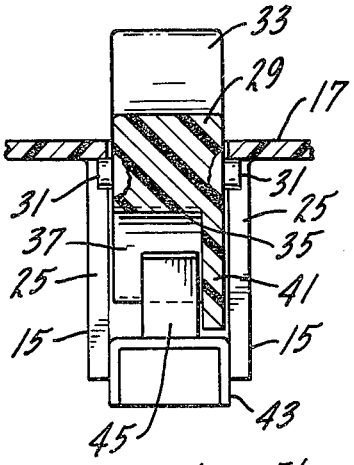
FIG. 3 is a cross-sectional view taken along line 3—3 of FIG. 2.

One embodiment of the rocker type electrical switch assembly of this invention is shown in FIGS. 1 through 3 of the drawings. The assembly includes a housing 11 having end walls 13, side walls 15 and a front wall 17. These walls define a cavity 19. Openings 21 and 23 lead into the cavity respectively from the front and rear of the housing. Aligned guides in the form of slots 25 extend through the side walls 15 of the housing and are continuous from the rear of the housing to the rear face of the front wall 17.

An arcuate rocker 29 is equipped with integral trunnions 31 which fit into the slots 25. The diameters of the trunnions may be less than the width of the slots. The rocker has a concave face portion 33 which extends cutwardly through the opening 21 in the housing when the trunnions are located at the front end of the slots 25 as shown in FIG. 2. A portion of the rocker 29 located diametrically opposite to the concave face 33 is cut away at least partially through the thickness of the rocker at 35 to form fingers 37 and 39 and to leave a side wall 41.

A slide switch 43 is positioned in the rear opening 23 of the housing 11. This switch has an operating lever 45 which extends into the cavity 19 and into the cut away portion 35 of the rocker 29 where it can be engaged by the fingers 37 and 39. When the slide switch is located in the housing in the manner shown in FIG. 2, it will engage the peripheral edge 47 of the rocker 29 thereby holding the roller in the cavity with its trunnions 31 located at the front end of the slots 25. This may be accomplished by proper dimensioning of the rocker, slots and cavity.

For clarity of illustration, the means for fastening the slide switch to the housing 11 and the electrical wires connected to the switch have been omitted since these may be conventional. Also, some of the details of the slide switch have been omitted for the same reason.

Figure 4:
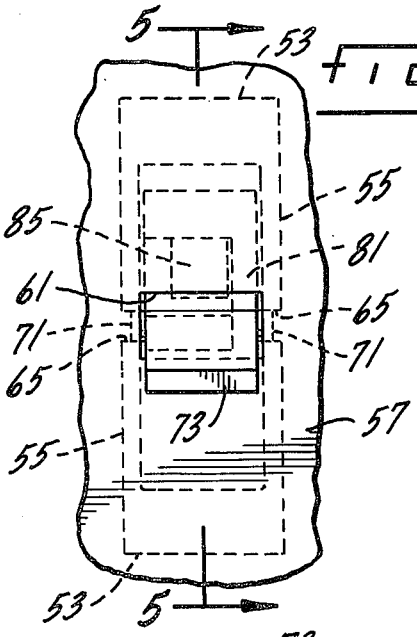
FIG. 4 is a partial front elevational view of another embodiment of this invention.
Figure 5:
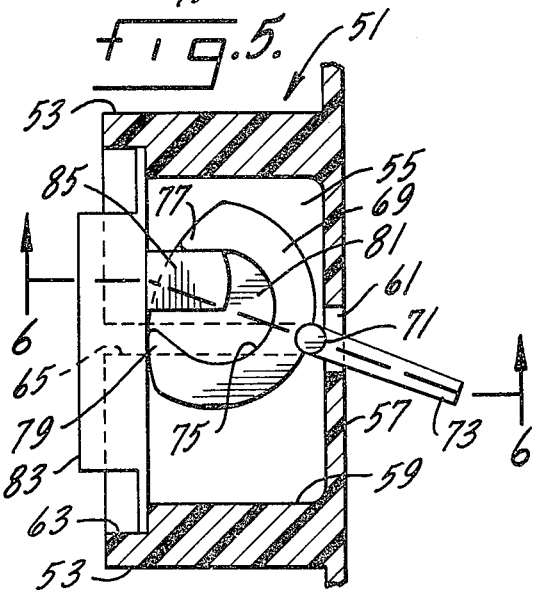
FIG. 5 is a cross-sectional view taken along line 5—5 of FIG. 4.
Figure 6:
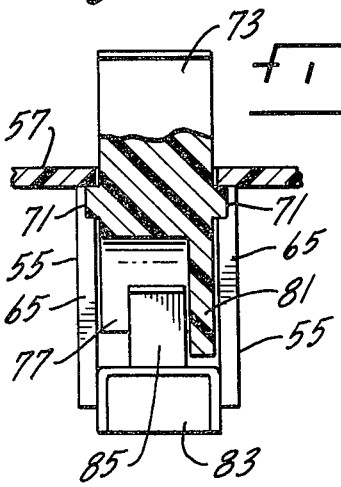
FIG. 6 is a cross-sectional view taken along line 6—6 of FIG. 5.

A modified form of actuating mechanism embodied in a rocker type switch is shown in FIGS. 4 through 6 of the drawings. The switch includes a housing 51 having end walls 53, side walls 55 and a front wall 57. These walls define a cavity 59. Openings 61 and 63 lead into the cavity respectively from the front and rear of the housing. Aligned guides in the form of slots 65 extend through the side walls 55 of the housing and are continuous from the rear of the housing to the rear face of the front wall 57.

An arcuate rocker 69 having integral trunnions 71 is located in the cavity with its trunnions positioned in the slots 65. Formed integrally with the arcuate rocker is an operating lever 73 which extends out of the housing through the front opening 61. A portion 75 of the arcuate rocker is cut away at least part way through the thickness of the rocker to form fingers 77 and 79. The cut away portion stops short of the thickness of the arcuate rocker leaving a side wall 81.

A slide switch 83 is positioned in the rear opening 63 of the housing. This switch has an operating lever 85 which extends into the cavity of the housing and into the cut away portion 75 of the arcuate rocker 69 where it can be engaged by the fingers 77, 79. When the slide switch is located in the housing in the manner shown in FIG. 5, it will engage the edge of the rocker 69 thereby holding the rocker in the cavity with its trunnions 71 locoated at the front end of the slots 65. This may be accomplished by proper dimensioning of the rocker, slots and cavity.

The means for fastening the slide switch to the housing and the electrical wires connected to the slide switch have been omitted for clarity of illustration since they may be conventional. Also, some of the details of the slide switch have been omitted for the same reason.

Figure 7:
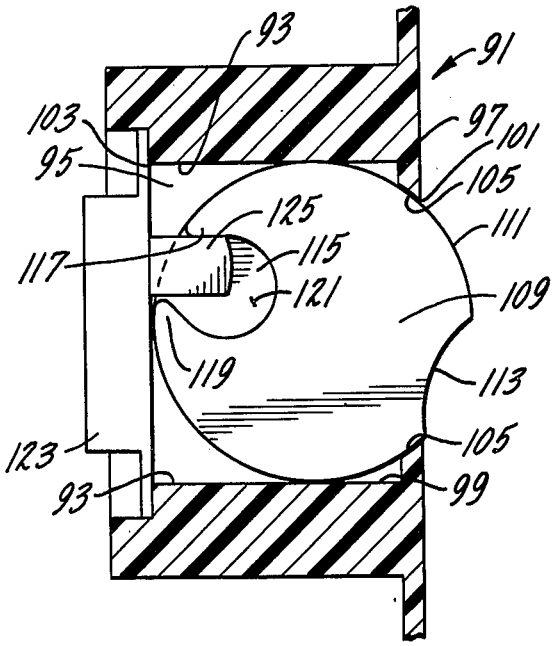
FIG. 7 is a cross-sectional view of another embodiment of this invention.

Another modified form of actuating mechanism embodied in a rocker type switch is shown in FIG. 7 of the drawings. The switch includes a housing 91 having end walls 93, side walls 95 and a front wall 97 defining a cavity 99. Openings 101 and 103 lead into the cavity respectively from the front and rear of the housing. The front wall is formed with facing arcuate surfaces 105 which act as bearings.

An arcuate rocker 109 is located in the cavity with its peripheral surface 111 contacting the end walls 93 and the arcuate surfaces 105. The rocker has a concave face portion 113 which is located outwardly of the opening 101 when the rocker is located completely in the cavity. A portion of the rocker located generally diametrically opposite to the concave face portion is cut away at least partially through the thickness of the rocker at 115 to form fingers 117 and 119 and leave a side wall 121.

A slide switch 123 is positioned in the rear opening 103 of the housing 91. This switch has an operating lever 125 which extends into the cavity 99 and into the cut away portion 115 of the rocker 109 where it is engaged by the fingers 117 and 119. When the slide switch is positioned at the opening of the housing in the manner shown in FIG. 7, it will engage the peripheral edge surface 111 of the rocker 109 thereby holding the roller in position in the cavity so that the peripheral edge will also contact and bear upon the facing arcuate surfaces 105 of the front wall 97. The peripheral edge surface of the rocker may also contact the end walls 93 but this is not absolutely necessary if the rocker bears against the arcuate surfaces 105 and the slide switch 123.

As in the other example, the means for fastening the slide switch to the housing 91 and the electrical wires normally connected to the switch have been omitted since these may be of conventional construction. Also, some of the details of the slide switch have been omitted for the same reason.

Figure 8:
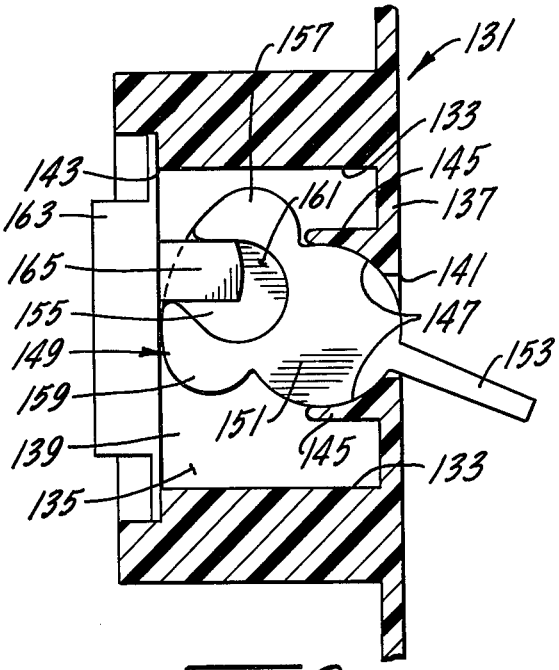
FIG. 8 is a cross-sectional view of yet another embodiment of this invention.

Yet another modified form of actuating mechanism embodied in a rocker type switch is shown in FIG. 8 of the drawings. This switch includes a housing 131 having end walls 133, side walls 135 and a front wall 137 defining a cavity 139. Openings 141 and 143 lead into the cavity respectively from the front and rear of the housing. Inwardly extending flanges 145 are formed on the front wall 137 surrounding the opening 141. These flanges are formed with inwardly oppositely facing arcuate bearing surfaces 147.

A rocker 149 having a trunnion portion 151 is located in the cavity with its trunnion seated on the arcuate bearing surfaces 147. Formed integrally with the rocker is operating lever 153 which extends out of the housing through the front opening 141. A portion 155 of the rocker is cut away at least part way through the thickness thereof to form fingers 157 and 159. The cut away portion is short of the thickness of the rocker leaving a side wall 161.

A slide switch 163 is positioned in the rear opening 143 of the housing. This switch has an operating lever 165 which extends into the cavity of the housing and into the cut away portion 155 of the rocker 149 where it is engaged by the fingers 157 and 159. When the slide switch is located in the housing in the manner shown in FIG. 8. It will engage a peripheral edge of the rocker 149 thereby holding the roller in the cavity with its trunnion portion 159 held against the arcuate bearing surfaces 147.

The means for fastening the slide switch to the housing and the electrical wires connected to the slide switch have been omitted for clarity of illustration since they may be conventional. Also, some of the details of the slide switch have been omitted for the same reason.

The use, operation and function of this invention are as follows:

This invention provides an actuating mechanism of the rocker type which is easily manufactured and assembled. The actuating mechanism has been shown and described as embodied in a rocker type switch but it should be understood that this is only one use of the actuator and the showing is by way of example and not limitation. One of the many advantages of this invention is obtained by providing a rocker which does not have to be fixed in position in the housing before final assembly. This invention utilizes the closure member for the housing, which in the examples has been the switch, to hold the roller in its proper position for rotation about a fixed axis. The opening in the housing for insertion of the rocker has been called the rear opening for convenience of explanation and is the opening closed by the switch. The front opening, which is the opening opposite the rear opening, generally is smaller to allow no more than a portion of the rocker to extend outwardly of the housing where it can be contacted for actuating purposes.

In the first embodiment of the invention, the restraining means includes trunnions 31 which ride in the slots 35 and engage the rear face of the front wall 17 of the housing. The peripheral edge 47 of the rocker engages the opposed end walls 13 of the housing forming a three point contact for the roller which holds the rocker in position and prevents movement in any direction except towards the rear opening 23. When the switch 43 is installed, it engages the rocker and holds the rocker fixed about its axis of rotation.

In the embodiment of FIGS. 4 through 6, the engagement of the trunnions 71 with the walls of the slots 74 and the contact with the front wall 57 of the housing holds the rocker in position against movement in all directions except towards the rear opening. Here again, the switch 83 engages the peripheral edge of the rocker to fix the roller for rotation about the trunnions 71.

In the embodiment of FIG. 7, trunnions are omitted and the arcuate surfaces 105 of the front wall 97 hold the rocker against movement in all directions except towards the rear opening 103 during assembly. Again, the switch 123 engages the peripheral surface 111 of the rocker to hold the roller for rotation about a fixed axis.

In the embodiment shown in FIG. 8, the engagement of the trunnion portion 151 with the arcuate bearing surfaces 147 seats the rocker and prevents movement in all directions except towards the rear opening 143 during assembly. Again, the switch 163 engages the peripheral edge of the rocker to hold the rocker in position for rotation about a fixed axis.

Whereas, the preferred forms of the invention have been described and shown, it should be understood that there are modifications, alterations and changes which may be made without departing from the teachings of the invention. Therefore, the scope of the invention should be determined by the claims attached hereto.

I claim:

1. An actuating mechanism including:

a housing having side, front and rear walls defining a cavity, front and rear openings formed in said front and rear walls and leading into said cavity, a rocker positioned in said cavity, said rear opening being dimensioned to allow said rocker to be inserted therethrough into said cavity, means engaging said rocker to permit no more than a portion of said rocker to project out of said housing through said front opening and to limit movement of said rocker in directions other than towards said rear opening, a member closing said rear opening and having an inner wall engaging said rocker to limit movement of said rocker towards said rear opening thereby holding said rocker for rotation of about a fixed axis, and actuating means formed as a part of said rocker.

2. The actuating mechanism of claim 1 in which said means engaging said rocker to restrain movement of said rocker other than towards and away from said front and rear openings includes opposed end walls engaging the periphery of said rocker.

3. The actuating member of claim 1 in which trunnions are formed on said rocker, and said means engaging said rocker to restrain movement of said rocker other than towards and away from said front and rear openings includes trunnion receiving grooves formed in said side walls.

4. The actuating mechanism of claim 1 in which said means engaging said rocker to limit movement of the rocker towards said front opening and said means engaging said rocker to restrain movement of said rocker other than towards and away from said front and rear openings includes spaced, arcuate surfaces engaging the periphery of said rocker with said surfaces formed as parts of said housing.

5. An electrical switch assembly including:

a housing having side, front and rear walls defining a cavity, front and rear openings formed respectively in said front and rear walls and leading into said cavity, a rocker positioned in said cavity, said rear opening being dimensioned to allow said rocker to be inserted therethrough into said cavity, means engaging said rocker to limit movement of the rocker towards said front opening and to allow no more than a portion of said rocker to project out of said housing through said front opening, means engaging such rocker to restrain movement of said rocker other than towards and away from said front and rear openings, a member closing said rear opening and engaging said rocker and cooperating with said other means to hold said rocker in said cavity for rotation of about a fixed axis, a switch having an operating member extending into said cavity, and means formed as a part of said rocker for engaging and moving said switch operating member upon rotation of said rocker.

6. The switch assembly of claim 5 in which said member closing said rear opening and contacting said rocker and cooperating with said other means to hold said rocker in said cavity for rotation about a fixed axis is a housing enclosing said switch.

7. The switch assembly of claim 5 in which said means engaging said rocker to restrain movement of said rocker other than towards and away from said front and rear openings includes opposed end walls engaging the periphery of said rocker.

8. The switch assembly of claim 5 in which trunnions are formed on said rocker, and said means engaging said rocker to restrain movement of said rocker other than towards and away from said front and rear openings includes trunnion receiving grooves formed in said side walls.

9. The switch assembly of claim 5 in which said means engaging said rocker to limit movement of the rocker towards said front opening and said means engaging said rocker to restrain movement of said rocker other than towards and away from said front and rear openings includes spaced, arcuate surfaces engaging the periphery of said rocker with said surfaces formed as parts of said housing.

* * * * *